US005840416A

United States Patent [19]

Repo

[11] Patent Number: 5,840,416

[45] Date of Patent: Nov. 24, 1998

[54] LINING MATERIAL, METHOD FOR COATING A MATERIAL FOR PRODUCING A LINING, AND APPARATUS

[75] Inventor: Harri Repo, Herrala, Finland

[73] Assignee: Clariant Finance (BVI), Ltd., Tortola, Virgin Islands (Br.)

[21] Appl. No.: 256,011

[22] PCT Filed: Dec. 15, 1992

[86] PCT No.: PCT/FI92/00342

§ 371 Date: Jul. 14, 1994

§ 102(e) Date: Jul. 14, 1994

[87] PCT Pub. No.: WO93/13264

PCT Pub. Date: Jul. 8, 1993

[30] Foreign Application Priority Data

Dec. 18, 1991 [FI] Finland ..... 915948

[51] Int. Cl.[6] ..... D32B 5/16; B05D 3/02; B05C 11/00

[52] U.S. Cl. ..... 428/323; 428/324; 428/331; 428/425.1; 428/454; 428/481; 428/571; 427/382; 427/362; 427/366; 427/389.9; 427/391; 427/394; 427/395; 118/60; 118/642; 118/643

[58] Field of Search ..... 428/323, 324, 428/331, 411.1, 425.1, 454, 481, 482, 507, 511, 389.9, 391, 394, 395, 382; 427/55, 316, 326, 362, 366, 382; 118/60, 642, 643

[56] References Cited

U.S. PATENT DOCUMENTS

| | | |
|---|---|---|
| 3,364,061 | 1/1968 | Mitchell et al. . |
| 3,664,912 | 5/1972 | Olson . |
| 4,900,583 | 2/1990 | Hirabayashi et al. . |
| 4,929,470 | 5/1990 | Rittenhouse et al. . |

FOREIGN PATENT DOCUMENTS

| | | |
|---|---|---|
| 000241 | 1/1979 | European Pat. Off. . |
| 0 000 241 | 10/1979 | European Pat. Off. . |
| 0 303 790 | 2/1989 | European Pat. Off. . |
| 52-118016 | 10/1977 | Japan . |
| 443 169 | 2/1986 | Sweden . |
| 464 195 | 3/1991 | Sweden . |

OTHER PUBLICATIONS

Abstract of Japanese Patent 52118016.

*Primary Examiner*—Newton Edwards
*Assistant Examiner*—J. M. Gray
*Attorney, Agent, or Firm*—Pollock, Vande Sande & Priddy

[57] ABSTRACT

A lining material for forming a tight barrier coating on a base material. The lining includes a thermoplastic polymer that does not cross-link in an aqueous dispersion. The thermoplastic polymer is 65%–85% of lining by dry matter weight. The lining also includes an additive including at least one particulate material having barrier-forming properties and in an aqueous dispersion. The additive is 15%–35% of the lining by dry matter weight. At least 95% of the particles of at least one particulate material fulfill the condition that the ratio between the largest and the smallest dimension of a particle of the particulate material is greater than 5:1.

24 Claims, 2 Drawing Sheets

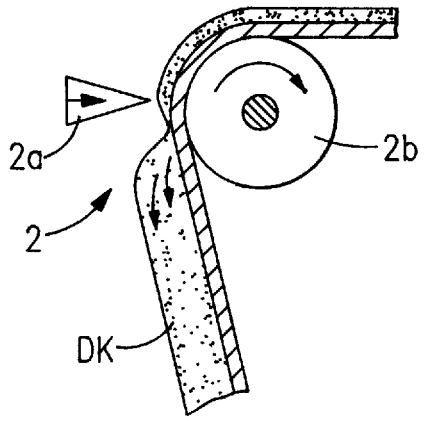
FIG.2
FIG.3
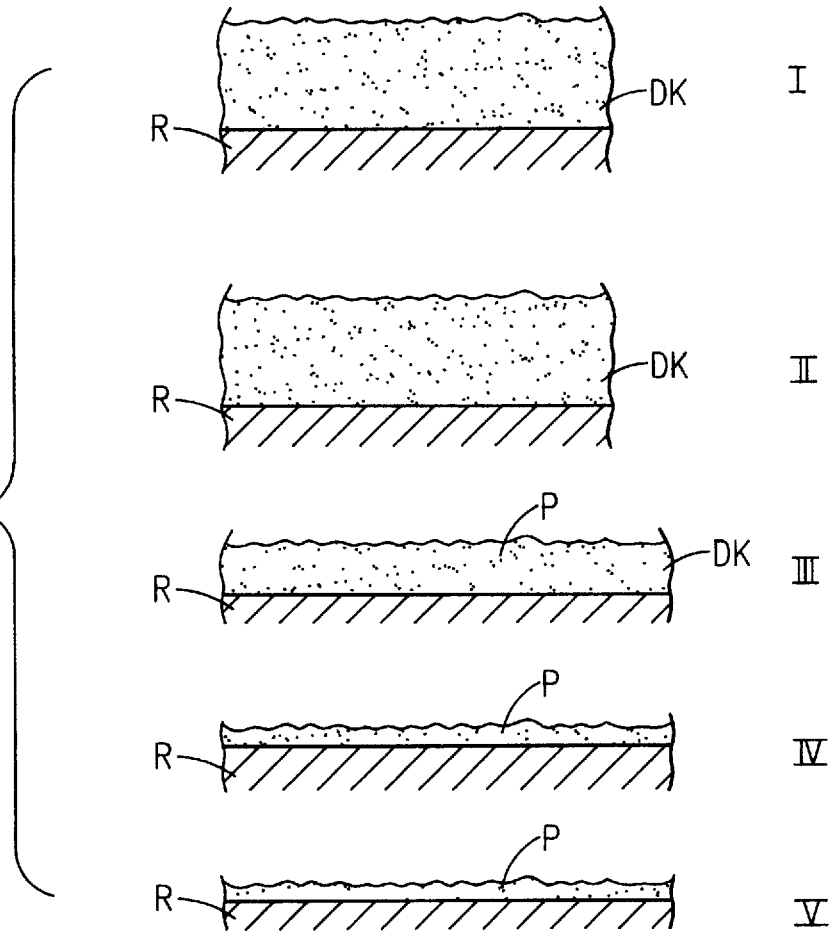

LINING MATERIAL, METHOD FOR COATING A MATERIAL FOR PRODUCING A LINING, AND APPARATUS

FIELD OF THE INVENTION

The present invention relates to a lining material.

Particularly, but not exclusively, the invention relates to a lining used for coating a plastic or fiber material in a manner that at least one of the surfaces of a sheet-like, film-like or web-like material carries the lining. The lining has thermoplastic properties and is capable of providing desired tightness properties.

BACKGROUND OF THE INVENTION

Until now, linings suitable for the above purpose have been primarily produced by the application of two methods. It can be said that the first method is effected by delivering melted polymer through a slit orifice onto the surface of a web-like material. The polymers used in this method are polyoleofines, which have been melted from a granular starting material for delivering it through a slit orifice. The melt polymer stock is delivered in a single layer or in plural layers directly onto a web-like material advancing on a carrier track with temperature in the contact area typically within the range of 120°–240° C. It is obvious that this produces a corresponding thermal stress for a material to be coated. A natural consequence of this is that a major thermal stress limits the use of heat-sensitive materials in the applications of this method. Although, at least in some applications, it is possible to cool the carrier track, that is, the backing surface.

In addition, a method based on the delivery of polymer effected through a slit orifice is typically hampered by problems associated with the adhesion of a coating. For example, when coating cardboard by using PET (polyethylene terephtalate), suitable raw materials are scarcely available. Also, use requires that an apparatus for effecting the method be provided with expensive accessories. One example of the above can be said to be the commercially available. MELINAR 102 S, which is used by Iggesund and is more expensive than a basic polyester by about 20%. In addition, an apparatus for applying the method by using the above Melinar 102 S polymer requires a specially designed extruder provided with a screw mechanism required by polyethylene terephtalate, as well as a pressure-equalizing pump. There is further required a separate cardboard pretreatment mechanism, which is fitted with heating and ozonation units, the latter explicitly for oxidation. Another drawback in the method is that, if the desired end product includes hot-sealing linings, the adhesion can only be achieved by applying appropriate primers on top of the polyethylene terephtalate layer or by applying oriented polyethylene terephtalate layer (PET or OPET) serving as a basic coating. The primers must be applied prior to the application of a top-layer coating in a separate preceding process stage. The hot-sealing properties for a lining can be produced, for example, by low density polyethylene (LDPE).

Furthermore, when using a method based on slit orifice technology, there will be drawbacks especially when applying a coating on porous materials. The fact is that the melt polymer stock to be applied on the surface of a porous material easily develops pinholes. Thus, this method cannot be used to control the tightness properties of a lining. In order to overcome this drawback and especially to produce a smooth lining, for example, to prevent the penetration of fat, a method based on slit orifice technology generally requires an increase in the thickness of a coating, essentially a polymer layer, to be applied. This is naturally something that increases the consumption of polymer and, thus, the price of an end product. Thick linings create a problem in terms of recycling. Also thick linings generally require, in the processing of recycled stock, especially in the de-inking process, pulper mechanisms designed especially for this purpose.

On the other hand, the use of pigments and fillers in a method based on slit orifice technology is limited by the fact that the above materials will be subjected to thermal and compression stress in a compounding step effected in the slit orifice, whereby the gases released especially from fillers are extremely likely to ruin the properties of an end product as far as tightness is concerned.

Another prior art method associated with the production of a lining according to the invention for coating materials to create a lining is a so-called varnishing method. In a varnishing method, the application of varnish is effected by using various printing processes. Typical varnish coatings have included a polyvinylidene chloride (PVdC) water dispersion and nitrogen cellulose (NC). The application of varnish coating agents has been effected either in a gravure printing unit or by using a separate varnishing machine. The linings can be provided with a better gas tightness by using a PVCD-based varnish coating. However, the equipment using the varnishing technique is expensive and, hence, its application has been limited to the use of just a few manufacturers. Especially when the material to be coated is cardboard, the varnishing technique has been capable of producing primarily aesthetic changes, particularly gloss and mar resistance in regard to printing inks as well as protection against yellowing. In practice, pigments and fillers are not used in the varnishing technique. However, the varnishing technique may involve the use of additives required by itself as well as additives possibly intended for conditioning optical qualities.

SUMMARY OF THE INVENTION

An object of the present invention is to introduce a lining material, that is capable of eliminating as thoroughly as possible the drawbacks found in the prior art linings. The lining material also facilitates a diversified selection of the properties for the lining according to the intended application of a relevant material upon which the lining will be applied. In order to achieve this object, a lining material of the invention is primarily characterized by consisting of at least one thermoplastic polymer, which is not cross-linked when dispersed with water. The lining also consists of an additive, which has at least one particulate material selected on the basis of covering properties. The additive can also be brought into the form of a water dispersion.

Furthermore, one preferred embodiment of a lining material is characterized in that, in regard to a dry matter and in percent by weight, it consists essentially of 65–85% of a thermoplastic polymer and of 15–35% of an additive. Also, at least ten percent by weight of a dry matter in the additive includes particles with covering properties. The particles have an equivalent diameter of less than ten $\mu$m and more than two $\mu$m. The particles are selected in such a manner that at least 95 percent of them can fulfill the following condition: the ratio X/Y is more than 5, preferably more than 8. The ratio X/Y relates to the ratio between the largest and the smallest dimension of a particle included in a particular group.

According to the invention, the term additive is used in reference to the following combination of partial components, which at least in most practical applications has the following composition:

a) at least one covering (developing so-called barrier properties) partial component, such as talc or a mixture of talc and silica, b) at least one possible inert partial component, such as a filler and/or titanium oxide (whiteness, opacity), and c) at least one possible partial adjunct component, particularly for bearing an effect on the processing properties of a coating used in the production of a lining material.

Other preferred characterizing features of a lining material of the invention are set forth below.

Another object of the present invention is to introduce a novel type of method for coating a material in view of producing a lining. The method can eliminate as thoroughly as possible the drawbacks found in the prior art. Thus, the method can raise the current state of art as well as produce a lining material of the invention on the surface of a material. In order to achieve this object, a method of the invention is primarily characterized by comprising the following operations:

producing a dispersion, including

A) water,

B) at least one thermoplastic polymer material and

C) a particulate additive, consisting of at least one material having covering properties, applying the dispersion on the material surface as a layer, subjecting the dispersion layer to a sudden thermal effect in view of bringing about the bonding, preferably cross-linking at least partially, of at least one thermoplastic polymer material contained in the layer still at least partially in the form of a dispersion, whereby the additive consisting at least partially of a particulate material is at least partially linked with the bonding, preferably cross-linking polymer layer, and drying the layer at least partially in the form of a dispersion for removing the aqueous component essentially at a temperature that is preferably lower than the bonding temperature of the thermoplastic polymer material.

The above-described method, by using a dispersion comprising at least one thermoplastic polymer material and at least a partially particulate additive consisting of at least one material and by selecting the materials used in the dispersion, can be capable of producing desired lining properties, especially by controlling the process operations, as described in more detail hereinafter. A particularly significant advantage gained by the method is that, having been applied on a material surface as a layer, the dispersion is subjected to a sudden thermal effect in a manner that the quick thermal energy applied to the layer does not exert thermal stress on the actual material to be coated. The material to be coated is protected by the dispersion, whereby a temperature resulting in the bonding, preferably cross-linking, of at least one thermoplastic polymer material can be reached in the polymer material, concentrating on the surface of the dispersion and including a particulate, covering additive. Between the above-mentioned developing layer and the material there is a dispersion layer protecting the material against the harmful effects caused by the excessive rise of temperature. This layer can be removed from the coating at a lower temperature prevailing in a separate drying unit, for example, by the application of normal evaporation.

According to another preferred embodiment for a method of the invention, the dispersion is formulated so as to contain in percent by weight:

A) water 30–65%

B) at least one thermoplastic polymer 25–60%, and

C) an additive 10–65%

This solution offers the advantage that, by selecting the dispersion components (as percent by weight in dispersion) within the above percentage range, it is possible to obtain, in substantially all practical situations, the desired and controlled lining properties by controlling the process operations as required by a particular lining. It should be obvious to a person skilled in the art that the applied process quantities must be found out by practical test arrangements. It is obvious that each one of the components can already be in the form of a water dispersion in the dispersion formulating step.

Another embodiment for a method of the invention is characterized in that the additive has a composition with at least ten percent by weight thereof comprising particles having an equivalent diameter of less than ten $\mu$m and more than two $\mu$m. The particles are selected in a manner that at least 95% thereof are capable of fulfilling the condition: ratio X/Y is more than 5, preferably more than 8. The ratio X/Y relates to the ratio between the largest and the smallest dimension of a particle included in this particular group.

The above-described additive can be used to produce a lining, having very good covering properties and providing desired barrier qualities. The lining is produced when the bonding, preferably cross-linking thermoplastic polymer experiences its bonding, preferably cross-linking effect. In this context, the equivalent diameter refers to the diameter of such a sphere that has corresponding sedimentation properties (sedigraph test).

In general, the additive can be defined more accurately as follows:

a) at least 10% by weight of the additive comprises a covering partial component, (for example, talc, whose particles have an equivalent diameter of $2<\phi<10$ $\mu$m and by 95 percent fulfil the condition X/Y>(5) 8), the range of variation being 10–98%, preferably 40–80%, b) an inert partial component comprises 0–85%, preferably 20–40% by weight of the additive, and c) a partial adjunct component comprises 0–5%, preferably 2–5% of the additive.

According to one preferred embodiment of a method of the invention, the thermoplastic cross-linking polymer material comprises polymer or a copolymer compound (PVdC), polyurethane (PU), polyester (PET) and/or polystyrene (PS) of acryl (PMMA) and/or vinyl (PVC).

The above-listed exemplary polymer materials, either alone or as a combination of two or more polymers, are preferred in view of carrying out the invention, especially on the basis of their cross-linking properties. In general, it can be concluded that the relevant thermoplastic polymers are selected on the basis of the hardness, tightness and jointing properties of a lining for optimizing the combination of qualities so as to suit the intended application.

Still, according to another preferred embodiment for a method of the invention, the application of a dispersion is effected in two operations in a manner that the first operation comprises a so-called roll application step or a like, wherein the dispersion is placed in a container for delivering it there-from directly or indirectly by way of at least one roll unit or a like to at least one surface of a material, and the second operation comprises the final smoothing step of a dispersion layer effected by means of jet-like blowing of a fluidized medium, especially a gaseous medium.

The above-described process-technical operation can be used to make sure that the dispersion is uniformly spread or applied on a material surface, so that there is a sufficient layer of the dispersion for the following operations included in the method. Furthermore, by adjusting the equipment for carrying out the first and/or the second operation it is possible to manipulate the thickness of a dispersion layer for controlling the process. In this context, the fluidized medium refers especially to a gaseous medium, such as air, set in a kinetic state.

Furthermore, according to a preferred embodiment for a method associated with the application of a dispersion, the rotating direction of a roll unit, or a like, spreading the dispersion on at least one surface of a material in the first operation is selected to be opposite with respect to the material advancing direction at the roll unit, or the like.

The above-described process-technical operation can be used in the first operation to effect a so-called roll application step, or a like, in a manner such that the roll unit, or a like, for transferring the dispersion onto a material surface delivers the dispersion over a relatively long contact area between the outer surface of a roll unit, or a like, and the material surface, wherein the dispersion essentially produces between the outer surface of a roll unit and the material surface a film layer that is advanced to the second operation for final smoothing and, in many cases, also for thinning the dispersion film layer. In a particularly preferred case, especially when applying the method for lining or coating a continuous web-like material, such as a plastic- or fiber-based material, the first spreading step of a dispersion is effected by having the dispersion on the bottom surface of a moving web. Thus, according to one preferred embodiment, the first step or operation is located lower in vertical direction than the second operation. This is especially beneficial whenever the dispersion has high viscosity properties.

According to another preferred embodiment of the method, the sudden increase of temperature is effected in a manner that, after the spreading step, preferably after one second, the dispersion layer has a surface temperature of at least 100° C.

The above-described operation can be used to achieve the bonding, preferably cross-linking of a thermoplastic polymer material.

Below are disclosed a few other preferred embodiments for a method of the invention.

The invention relates also to an apparatus for coating a material in view of producing a lining. The apparatus is primarily characterized by comprising:

first and second elements for the application of a dispersion onto the surface of a material in two operations, means for raising the dispersion temperature abruptly, and elements for drying the dispersion in view of producing a lining.

The above solution is capable of providing a preferred apparatus for carrying out the method and, thus, for producing a lining material on the surface of a material.

A few preferred embodiments for the apparatus are disclosed below.

BRIEF DESCRIPTION OF THE DRAWINGS

A method, an apparatus and a lining material of the invention will now be described in more detail with reference made to the accompanying drawings, in which FIG. 2 represents a schematic side view showing particularly the application step of a coating having a high viscosity, and FIG. 3 represents a schematic view in association with reference numerals I–V in FIG. 1, showing sequentially the progressive development of a lining by applying the method.

DETAILED DESCRIPTION OF THE INVENTION

Figure 1:
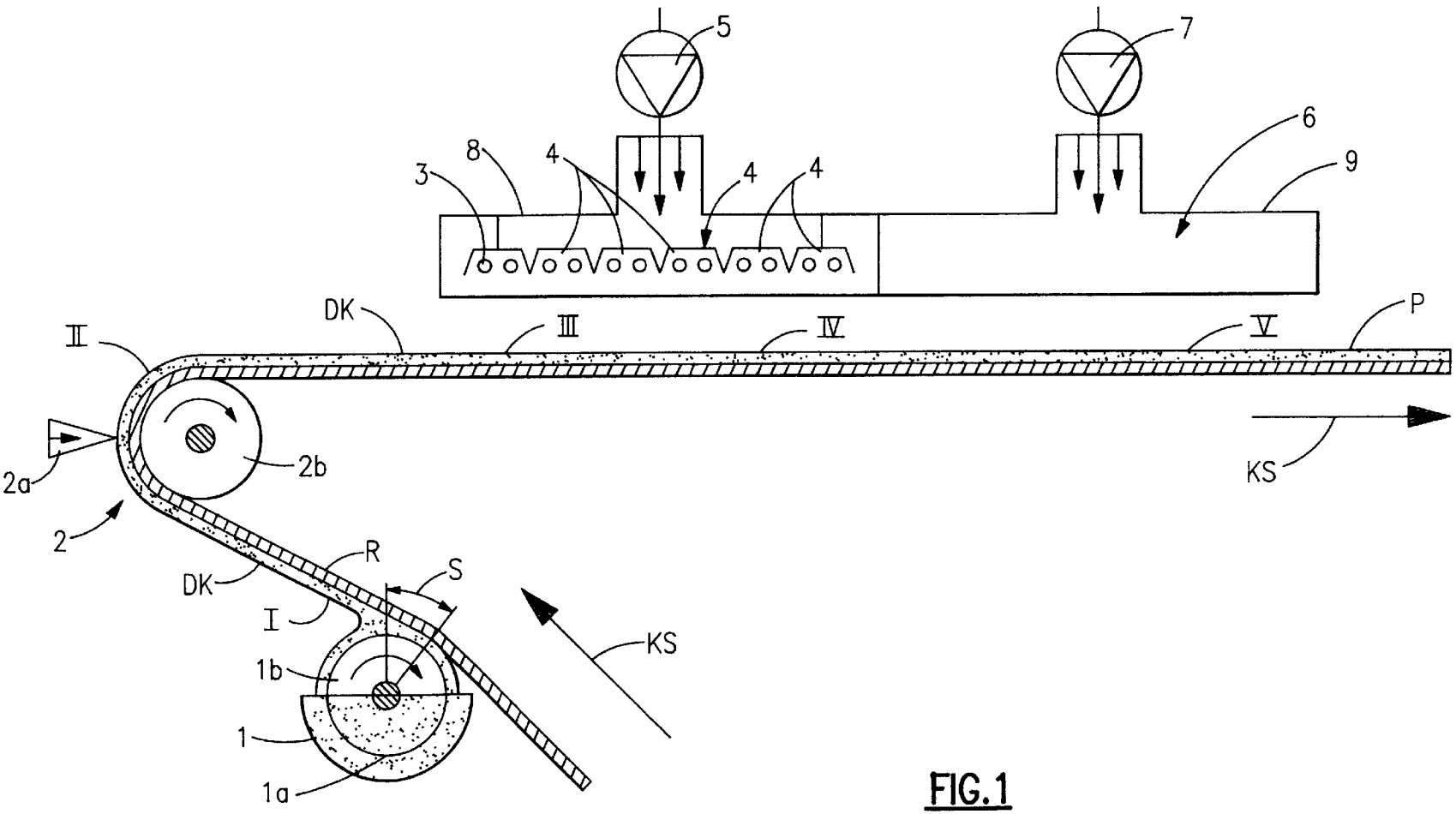
FIG. 1 represents a schematic side view showing one embodiment for an apparatus to carry out a method of the invention.

The apparatus shown in FIG. 1 for carrying out the method of the invention is adapted to effect continuous lining or coating of an advancing, web-like, plastic- or fiber-based material R (hereinafter a web). The apparatus includes as a first element (not shown in FIG. 1) an unrolling station. A web R stored in the form of a roll is carried from the first element to an application unit 1 included in the first operation. The unrolling station is provided with edge guiding and web tension control devices according to normal technology.

The first-stage application unit 1 includes a container 1*a*, which contains a dispersion associated with a method of the invention. The dispersion which is continuously replenished while the method progresses as a continuous process. In addition, the application unit 1 includes a roll or cylinder unit 1*b*. The cylinder unit has a width at least substantially equal to that of the web. The cylinder unit is adapted to rotate around an axis transverse to the web advancing direction. The cylinder unit rotates in a manner such that its rotating direction within a contact zone S between web R and cylinder unit 1*b* is opposite relative to the advancing direction (arrow KS) of web R. The cylinder unit 1*b* effecting the first-stage roll application is in a continuous contact with the dispersion, carrying the latter upon its outer surface towards web R to be coated. The dispersion is spread or applied as the web R comes into contact with the first-stage cylinder unit 1*b* over a contact zone shaped as a sector in register with the top surface. The contact zone being indicated in FIG. 1 by an arrow S. Thus, a dispersion layer DK developing between web R and cylinder unit 1*b* within contact zone S proceeds along with web R to an application unit 2. The application unit 2 is included in the second stage or operation of dispersion spreading. The application unit includes a cylinder 2*b*, or the like, adapted to be transversely rotatable relative to the web advancing direction, as shown by arrows KS. The web R is directed around the cylinder in a manner such that the dispersion applied to its surface lies on the outer web surface while the inner surface of web R lies against the cylinder 2*b*, or the like. In register with and outside cylinder 2*b*, or the like, there is arranged at least one supply means 2*a* for a fluidized medium. The supply means is positioned in transverse direction over the entire width of web R the same way as cylinder 2*b*, or the like. The fluidized medium supply means or, in case the fluidized gaseous medium comprises air, a so-called air brush, effects the smoothing and/or thinning of the dispersion layer.

As shown especially in FIG. 1, the first-stage application cation unit 1 is located in vertical direction at a substantially lower level than the second-stage application unit 2 whereby, in a first stage or operation, the web R along with a dispersion layer DK carried thereby has a upwardly inclined passage from the first to the second operation.

Following the second-stage application unit 2, the web R, together with its applied dispersion layer DK, travels to a following process operation along a substantially horizontal passage. The web R arrives immediately in the vicinity of at least one heating unit 3 next in the traveling direction KS, whereby the dispersion layer DK is facing towards the heating unit 3. The heating unit 3 is mounted transversely in the traveling direction KS of web R to extend across the entire width of the web. In a particularly preferred case, the heating unit 3 comprises a heating unit using infrared radiation as an energy source. This heating unit 3 can be used for subjecting the dispersion layer DK to extremely rapid heating. According to the method, the heating results in the bonding, preferably cross-linking of at least one thermoplastic polymer while the temperature of dispersion layer DK, especially its surface temperature, rises very rapidly. Preferably, as the temperature of the dispersion layer rises, as quickly as one second, naturally depending on the web traveling speed and the output and location of unit 3, to a temperature range required by the bonding of a thermoplastic material. Hence, an additive included in the dispersion shall also be at least partially bound or set within the bonding, preferably cross-linking thermoplastic polymer. Since the rapid heating effect is focused and only has time to focus essentially on that surface of dispersion layer DK facing toward heating unit 3 for just as long as it takes to achieve the bonding, preferably cross-linking of at least one polymer material, the bottom side of the dispersion layer, i.e. the side closer to web R, shall remain as a so-called protective layer for preventing a substantial temperature increase. This provides the significant advantage that the method can also be applied to materials which, as such, are not capable of tolerating temperatures required for the bonding, preferably cross-bridging of a thermoplastic material. The heating output applied to the dispersion layer is 0.7 W/g±15% (watts/gram of dispersion).

Following the rapid heating operation effected by means of heating unit 3 is a drying operation 4. The drying operation may also employ drying air, which is blown by at least one fan 5 and is dried so as to bind water vapour, as well as an array of heating units 4*a*. Preferably, the heating units are adapted to operate on infrared radiation energy. However, most preferably they operate in a manner that the output thereof is substantially lower than the heating output of heating unit 3. Furthermore, the final step downstream of the heating and drying operation 3, 4, respectively, in the process is a dry cooling operation 6. In the dry cooling, the surface and thermoplastic properties of a dispersion layer, which has already substantially transformed into a lining, are finished by dry blowing only using at least one fan 7. Thereafter, the product can still be cooled by known cooling methods to a suitable temperature. The cooling is followed by winding or sheeting by using conventional equipment known to a skilled person. The operations 3, 4 and, indeed, 6 are carried out by using enclosed assemblies 8 and 9. Assemblies 8 and 9 have an open bottom facing towards dispersion layer DK and the lining, at least partially developed by now.

FIG. 2 schematically illustrates the spreading operation of dispersion layer DK at second application unit 2, where the dispersion layer consists of a high-viscosity material. As shown in the FIG. 2, web R is substantially vertical upon arriving in second-stage application unit 2. The dispersion layer DK is substantially thicker (up to 3–6 times thicker) between first-stage application unit 1 and second-stage application unit 2 than downstream of the second-stage application unit. Since the dispersion consists of a high-viscosity material, (within the range of 11–24 s, preferably about 15 as measured by measuring device DIN CUP 4), between application units 1 and 2, the material develops a thick layer contributing to the spreading of dispersion layer DK and to its penetration into web R with no weeping occurring therefrom.

FIG. 3 schematically illustrates the various operations included in the method. FIG. 1 includes Roman numerals I–V for illustrating the development of a coating or dispersion layer DK into a lining P throughout the various process operations. The dry matter content of dispersion layer DK and/or lining P in operations I–V is as follows:

| | | |
|---|---|---|
| Operation | I/II | 40–65%, preferably 45–55% |
| | III | 55–85%, preferably 60–80% |
| | IV | 70–95%, preferably 85–90% |
| | V | 85–100%, preferably 90–98% |

The invention and its operability are explained in the following working examples:

THE OPERATING APPARATUS

Experiments were conducted for the operability of the invention by designing a test apparatus for carrying out operations I–V, shown in FIGS. 1 and 3. The web advancing speed in the tests was 40 m/min. The formation capacity of a lining was 15 g/m$^2$. The web length required for this was 15 m. In practice, the apparatus was set up by using a multi-layer tunnel design. The apparatus had a total length of approximately 9–10 m, excluding the space required by unwinding and winding rollers.

Cylinder 1*b*, shown in FIG. 1, was a rubber-coated soft cylinder ϕ200–300 mm.

Cylinder 2*b*, shown in FIG. 1, was a hard rubber-coated cylinder (cardboard) and a ceramic cylinder (films) ϕ100–250 mm.

The consumption of energy for working a coating into a lining in the test apparatus resulted as follows:

| | |
|---|---|
| Heating (operation III) | 0.01 KW/m$^2$/15 g/m$^2$ of lining |
| Drying (operation IV) | 0.002 KW/m$^2$ |
| Fresh air cooling (operation IV) | 0.005 KW/m$^2$ |
| Dry cooling (operation V) | 0.001 KW/m$^2$ |

EXAMPLE 1

The object in this example was to make a coated folding cardboard backing, whose properties were to include fat tightness in view of using the coated folding cardboard backing particularly in bakery and processed food industry. Thus, the total amount of lining was 15 g/m$^2$ and the quadratic weight of folding cardboard was 275 g/m$^2$.

The employed polymer component was a polymer and copolymer combination of acryl and vinyl as follows:

TABLE 1

| (polymers) | | |
|---|---|---|
| Latex A: | PVC (polyvinyl chloride) | 60% |
| | PVdC (polyvinyldene chloride) | 30% and |
| | PMMA (polymethyl metacrylate) | 10% |
| Latex B: | PVC (polyvinyl chloride) | 30% |
| | PVdC (polyvinyldene chloride) | 15% and |
| | PMMA (polymethyl metacrylate) | 55% |

Furthermore, the employed additive component included two compositions according to Table 2. Table 1 also discloses latexes A and B.

TABLE 2

| Recipes used in the example | | |
|---|---|---|
| | Example 1 | Example 2 |
| Talc | 24 | 12 |
| Silica | | 6 |
| Latex A | 100 | |
| Latex B | | 100 |
| Dispersing agent | 0.4 | 0.1 |
| Moistening agent | 0.8 | 0.2 |
| pH regulating agent | 0.7 | 0.6 |

Penetration properties are produced by the combined effect of the selection of talc and the polymer combination.

The particles of talc (the talc used in the example was modified from a talc variety sold by Norwegian Talc under the trade name MICROTALC AT1) have such a size distribution that at least eighty percent of all particles have an equivalent diameter less than 10 $\mu$m. In eighty percent, the diameter is more than 2 $\mu$m. In addition, at least 95% of the talc particles are capable of fulfilling the condition X/Y is more than 10. The ratio X/Y refers to the ratio between the largest and smallest dimension of a particle.

Tightness is obtained by setting the flat particles by means of a binder in an overlapping pattern and in superimposed layers in view of setting the particles in a correct pattern, it is possible to employ pigment additives, having a low X/Y ratio, for example silica (the type of silica used in Table 2, Example 2).

The coating of a folding cardboard web was effected according to the example with additives disclosed both in Example 1 and in Example 2 by using the polymer and copolymer combinations of acryl and vinyl in the same way as shown in Table 1. The resulting products had the following qualities as compared to basic cardboard.

TABLE 3

| Comparison of qualities | | | |
|---|---|---|---|
| Measured quality | basic cardboard | example 1 | example 2 |
| copp g/m$^2$ | 115 | 6 | 9 |
| MVTR g/m$^2$/24h | 1260 | 21 | 28 |

Specification:
COPP = moisture resistance test (absorption test) used by board and paper making industry.
MVTR = water vapour penetration test according to standard ASTM E96.

Specification

COPP=moisture resistance test (absorption test) used by board and paper making industry.

MVTR=water vapour penetration test according to standard ASTM E96.

It should be noted that the amount of dispersion was at the commencement of coating (wet) 25 g/m$^2$. The lined folding cardboard described in Example 1 had a dry matter content of 61% and that of example 2 had a dry matter content of 59%.

If an increase in the penetration of water vapour is desired, the talc component can be replaced by silica or some other filler having the X/Y ratio on 90% of the particles lower than 10 (5–8).

In particular, the optimization of tightness can be effected by using a double lining, whereby one and the same web is run, for example, twice successively through the process operations of the invention. The thickness of dispersion at the initial stage of coating (wet) can be typically within the range of 2 $\mu$m–25 $\mu$m.

Furthermore, the following discloses an experimental result including the composition shown in the example described in Table 2, shows how an increase of the dispersion surface temperature influences the water vapour penetration of a lining (MTVR value). Table 4 refers to measuring the surface temperature at the outermost boundary surface of a coating one second after the application of a dispersion layer. Thus, a heater (heating unit 3 shown in FIG. 1) has already by this time applied the heating effect to a dispersion layer.

TABLE 4

| The effect of surface temperature on the water vapour penetration of a coating | | | | | | | | |
|---|---|---|---|---|---|---|---|---|
| T [°C.] | 80 | 90 | 100 | 110 | 120 | 130 | 140 | 150 |
| MVTR [g/m$^2$/24h] | 280 | 264 | 196 | 162 | 84 | 33 | 29 | 24 |

Table 4 clearly shows the effect of temperature on tightness. It is based on the adjustment of a closed film thickness effected at the dispersion surface.

EXAMPLE 3

Particularly in commercial applications, the compositions described in table 2 can be replenished by the addition of fillers and dyestuffs, even in amounts exceeding the dry matter amounts of a covering partial component (talc or talc/silica) included in the compositions described in Table 2. The following discloses a few optional trade names, which were tested in test apparatus runs with the compositions of Example 1.

Table 5

Inert partial components included in additive

Filler (Inert material)

BLANCFIXE MICRO—manufactured by Sachtleben

MICRO MICA WT—manufactured by Norwegian Talc

Titanium oxide (whiteness, opacity)

TIOXIDE RCR 2—manufactured by Tioxide Group

HOMBITAN 710—manufactured by Sachtleben

These fillers and dyestuffs did not have an essential significance in terms of achieving covering as well as is other desired basic qualities of the invention. On the other hand, they were capable of achieving savings in the manufacturing costs of a lining as well as properties having a favorable effect on the appearance of a lining. The partial component of an inert additive can also be composed of dyestuffs other than white, if the lining is to be used for producing a colored coating. The partial component can also be composed of reflective pigments, such as those reflective within the UV, IR and visible light range, for example, for microwave applications, wherein a magnetron-generated microwave field is intensified and/or directed from the boundary surface of a coating.

EXAMPLE 4

The additive may contain adjunct components set forth in the following list for producing and adjusting various properties. The total amount of dry matter in weight percent maybe, at most, 5%, varying within the range of 0–5%, and preferably 2–5%. These were also tested in the test apparatus, for example, in amounts shown in the composition of Example 1.

Table 6

Adjunct components included in additive pH regulator

Ammonia, sodium hydroxide (used in the recipes of Table 1)

Viscosity

AEROSIL 200, 300—manufactured by Degussa

TEXIPOL 63-002—manufactured by Scott Bader

VERSACRYL AT 55—manufactured by Allied Colloids

Antiblock (anti-adhesive)

SLIPAID SL 417—manufactured by Daniel Products

KPS Wax—manufactured by Hoechst

Moistening (surface activity)

AEROSOL MA 80—manufactured by Cyanamid (used in the composition of Table 2)

DAPRO W77—manufactured by Daniel Products

Anti-foaming

BEVALOID 642—manufactured by Bevaloid

FOAMASTER H 2—manufactured by Diamond Shamrock

Dispersability properties

BYK 155—manufactured by BYK Chemie (used in the composition of Table 2)

NOPCOSANT K—manufactured by Diamond Shamrock

Skilled persons can use the above list on the basis of their knowledge of the art to select partial adjunct components bearing an effect on the desired properties, especially the processing properties in any given application.

EXAMPLE 5

The method was tested with various polymer combinations for producing linings that are preferred in terms of of binding a covering additive component as well as in terms of other properties, such as hot-sealing.

TABLE 7

Alternatives for thermoplastic polymer

| Polymer | amount used/total polymer in weight percent |
|---|---|
| PVC (polyvinyl chloride) | 10–70% |
| PVdC (polyvinyldene chloride) | 10–100% |
| PMMA (polymethyl metacrylate) | 10–100% |
| PU (polyurethane) | 10–100% |
| PET (polyester) | 10–100% |
| PS (polystyrene) | 10–100% |

EXAMPLE 6

100% PMMA—tested NEOCRYL BT 48, manufacture of ICI

EXAMPLE 7

100% PVdC tested DIOFAN 960, manufacture of BASF

EXAMPLE 8

| | |
|---|---|
| 75% PMMA/PS | (acryl-styrene copolymer ) - BT 44, manufacture of ICI and |
| 25% PU | (polyurethane) - R560, manufacture of ICI |

EXAMPLE 9

| | |
|---|---|
| 50% PVC/PVcD/PMMA | (acryl-vinyl copolymer) - HALOFLEX DP 402, manufacture of ICI |
| 50% | PVdC - DIOFAN 601 |

EXAMPLE 10

100% PU (polyurethane) NEOTAC A 570, manufacture of ICI.

All the above polymers and polymer combinations have been used in the test apparatus for coating tests with varying amounts of additive and the results essentially matched those obtained in Examples 1 and 2.

Thus, the thermoplastic polymers of the invention are characterized by not cross-linking in a water dispersion but appearing there in ionic form. The bonding of a thermoplastic polymer cannot be achieved until after removing the aqueous phase and reaching a temperature facilitating the cross-bridging. According to the invention, this occurs in a controlled fashion resulting in the form of a film or a membrane. The selected properties of a lining material can be affected by the selection of both materials and process conditions.

One further application for the lining material is as a laminate structure. The laminate structure includes a first layer of a web material and a lining layer on the inner surface thereof. A second layer is on top of the lining layer, preferably made of a web material and possibly provided with a lining layer of the invention. The lining layer/layers, laid between the first and second layers, can be provided with an adhesive. Alternatively, the bonding of a laminate structure can be effected, for example by hot-nip pressing, whereby the water has not been completely removed from at least one lining layer serving as an adhesive material. For certain applications, the first and/or second layer can be provided with a moisture barrier coating. A particularly preferred embodiment for the above laminate solution is such that the first and the second layer are made of a cellulose-based material, such as paper, cardboard or the like. Such a second layer is for producing a redusable, especially pulpable product, which is provided with a moisture barrier and is suitable, for example, for food wrappings. When conventional paper has an MVTR value of approximately 1600 g, a laminate solution as described above is capable of providing MVTR values of 3–10 while retaining the paper feel and also its recycling possibility. The production of laminate can be combined, for example, with the apparatus of FIG. 1 downstream thereof or the lamination can be carried out as a separate operation.

I claim:

1. A lining material for forming a tight barrier coating on a base material, said lining comprising:

a thermoplastic polymer that does not cross-link in an aqueous dispersion, said thermoplastic polymer being 65%–85% of said lining by dry matter weight;

an additive including at least one particulate material having barrier-forming properties and in an aqueous dispersion, said additive being 15%–35% of said lining by dry matter weight; and at least 95% of the particles of said at least one particulate material fulfilling the condition that the ratio between the largest and the smallest dimension of a particle of said particulate material is greater than 5:1.

2. A lining material according to claim 1, wherein the ratio is greater than 8:1.

3. A lining material according to claim 1, wherein at least ten percent by dry matter weight of said particles of said additive have barrier-forming properties and an equivalent diameter between ten μm and two μm.

4. A lining material according to claim 1, wherein said additive further includes at least one inert component having at least one property selected from the group consisting of filler properties and bleaching properties, said inert component being 1% to 85% of said additive by dry matter weight.

5. A lining material according to claim 4, wherein said inert component is 20% to 40% of said additive by dry matter weight.

6. A lining material according to claim 1, wherein the thermoplastic polymer material is selected from the group consisting of acrylates, polyvinylchlorides, polyurethanes, polyesters, and polystyrenes.

7. A lining material according to claim 1, wherein said particulate material is 10% to 98% of the additive by weight.

8. A lining material according to claim 7, wherein said particulate material is 40 to 80 percent of the additive by weight.

9. A lining material according to claim 1, wherein the additive includes at least one adjunct component affecting processing properties of said coating, said adjunct component is 0% to 5% of the additive by weight.

10. A lining material according to claim 9, wherein said at least one adjunct component is 2% to 5% of the additive by weight.

11. A lining material for forming a tight barrier coating on a base material, said lining comprising:

a thermoplastic polymer that does not cross-link in an aqueous dispersion, said thermoplastic polymer being 65%–85% of said lining by dry matter weight and including at least one member being selected from the group consisting of acrylates, polyvinylchlorides, polyurethanes, polyesters, and polystyrenes;

an additive including at least one particulate material having barrier-forming properties and at least one adjunct component affecting processing properties of said coating, said adjunct component is 0% to 5% of the additive by weight, said additive being in an aqueous dispersion and being 15%–35% of said lining by dry matter weight; and at least 95% of the particles of said at least one particulate material fulfill the condition that the ratio between the largest and the smallest dimensions of a particle of said particulate material is greater than 5:1, and at least ten percent by dry matter weight of said particles of said additive have barrier-forming properties and an equivalent diameter between ten μm and two μm.

12. A method for forming a non-porous barrier coating on a base material, said method comprising the steps of:

A) producing a dispersion including:

1) water being 30% to 65% of said dispersion by weight;

2) at least one thermoplastic cross-linking polymer being 25% to 60% of said dispersion by weight; and 3) a particulate additive being 10% to 35% of said dispersion by weight, said additive including at least one particulate material having barrier-forming properties, at least 95% of the particles of said at least one particulate material fulfill the condition that the ratio between the largest and the smallest dimension of a particle of said particulate material is greater that 5:1;

B) applying said dispersion as a layer on a surface of the base material;

C) abruptly subjecting said dispersion layer to heat to produce a temperature of at least 100° C. on a surface of said dispersion; and D) exposing said dispersion layer to a temperature less than 100° C. to remove said water.

13. A method according to claim 12, wherein at least 95% of the particles of said at least one particulate material fulfill the condition that the ratio between the largest and smallest dimension of a particle of said particulate material is greater than 8:1.

14. A method according to claim 12, wherein application of said dispersion is affected to thereby adjust the thickness of said dispersion layer and to seal pores in the base material to provide a barrier, said application including the steps of:

A) applying said dispersion onto at least one surface of the base material with a cylindrical application unit; and B) smoothing said dispersion layer by directing a fluidized medium toward said dispersion layer.

15. A method according to claim 14, wherein said cylindrical application unit rotates and the base material advances during application of said dispersion layer and the direction of rotation of the cylindrical application unit is opposite the direction in which the base material advances.

16. A method according to claim 14, wherein the base material is advanced during application of said dispersion layer, said smoothing of said dispersion layer is effected by a rotating cylinder unit, the direction of rotation of said cylinder unit is opposite the direction of the advancing base material, the base material thereafter being advanced to a heating unit.

17. A method according to claim 14, further comprising the step of:

after the application or smoothing of said dispersion layer raising the surface temperature of said dispersion layer to at least 100° C. within about one second.

18. A method according to claim 12, wherein:

step C includes subjecting the dispersion layer to heat and dry air blowing; and step D includes subjecting the dispersion layer to dry air blowing.

19. A method according to claim 12, further comprising the step of:

laying a top layer on the surface of said dispersion layer for producing a laminate structure, wherein said dispersion layer is positioned between said base layer and said top layer.

20. An apparatus for forming a non-porous barrier coating on a base material, said apparatus comprising:

first and second application elements for applying a layer of a dispersion on a surface of the base material;

elements for abruptly raising a surface temperature of said dispersion layer to at least 100° C.; and elements for drying said dispersion layer at a temperature below 100° C. to form a lining.

21. An apparatus according to claim 20, wherein said application elements apply said dispersion to the base material in two operations and include:

a first-stage applicator unit including a cylindrical application unit, said dispersion layer being held in a container for delivering it to said first-stage applicator unit directly or indirectly by said cylindrical application unit onto at least one surface of the base material; and a second-stage applicator unit for directing a jet-shaped fluidized medium in the direction of said dispersion layer to smooth a surface of said dispersion layer.

22. An apparatus according to claim 20, wherein said first-stage applicator unit is positioned at a lower vertical position than said second-stage applicator unit, and the base material travels between said first-stage applicator unit and said second-stage applicator unit in a substantially vertical direction.

23. An apparatus according to claim 20, wherein said elements for abruptly raising the surface temperature of said dispersion layer include at least one radiation emitting device, and radiation emitted by said at least one radiation emitting device at an effective distance from said dispersion layer causes a surface temperature of said dispersion layer to rise within one second to at least 100° C. to cause water in said dispersion to evaporate from said dispersion layer.

24. An apparatus according to claim 20, wherein said elements for abruptly raising a surface temperature of said dispersion include first elements for applying heat and dry air blowing to said dispersion layer, and said elements for drying said dispersion include second elements for applying dry air blowing to said dispersion layer, wherein a dry matter content of said dispersion layer downstream of said second elements is 85% to 100% by weight.

* * * * *